US006219500B1

(12) United States Patent
Byun

(10) Patent No.: US 6,219,500 B1
(45) Date of Patent: Apr. 17, 2001

(54) DEVELOPER LIQUID SQUEEGEE APPARATUS FOR LIQUID ELECTROPHOTOGRAPHIC PRINTER

(75) Inventor: Seung-Young Byun, Seongnam (KR)

(73) Assignee: Samsung Electronics Co, Ltd., Suwon (KR)

( * ) Notice: Subject to any disclaimer, the term of this patent is extended or adjusted under 35 U.S.C. 154(b) by 0 days.

(21) Appl. No.: 09/497,419

(22) Filed: Feb. 7, 2000

(30) Foreign Application Priority Data

Feb. 6, 1999 (KR) ..... 99-4096

(51) Int. Cl.[7] ..... G03G 15/10
(52) U.S. Cl. ..... 399/57; 399/249
(58) Field of Search ..... 399/249, 251, 399/345, 398, 75, 57

(56) References Cited

U.S. PATENT DOCUMENTS 5,481,342 * 1/1996 Arcaro et al. ..... 399/249
5,576,815 * 11/1996 Tecshendorf et al. ..... 399/249

* cited by examiner

*Primary Examiner*—Joan Pendegrass
(74) *Attorney, Agent, or Firm*—Robert E. Bushnell, Esq.

(57) ABSTRACT

A developer liquid squeegee apparatus for a liquid electrophotographic printer includes a wrap-around developer liquid removal arrangement for removing a wrap-around developer liquid. The removal arrangement compensates for malfunction or poor operation of an air nozzle for spraying airtoward the wrap-around developer liquid on both edges of a first squeegee roller usually provided in a development arrangement to avoid a wrap-around problem. The wrap-around developer liquid removing arrangement includes an optical sensor module provided directly under both edges of the development region of the photoreceptor belt for detecting the presence of the wrap-around developer liquid sticking to the photoreceptor belt, a second squeegee roller for removing the wrap-around developer liquid while selectively contacting the photoreceptor belt or a heating roller of a drying unit according to a signal indicative of the detection result of the optical sensor module, and a driver unit for selectively driving the second squeegee roller.

30 Claims, 6 Drawing Sheets

DEVELOPER LIQUID SQUEEGEE APPARATUS FOR LIQUID ELECTROPHOTOGRAPHIC PRINTER

CLAIM OF PRIORITY

This application makes reference to, incorporates the same herein, and claims all benefits accruing under 35 U.S.C. §119 from my application DEVELOPER LIQUID SQUEEGEE APPARATUS FOR LIQUID ELECTROPHOTOGRAPHIC PRINTER filed with the Korean Industrial Property Office on Feb. 6, 1999 and there duly assigned Ser. No. 4096/1999.

BACKGROUND OF THE INVENTION

1. Technical Field

The present invention relates to a liquid electrophotographic printer and, more particularly, to a developer liquid squeegee apparatus for removing excess developer liquid sticking to and wrapped around the recording surface of a photosensitive medium.

2. Related Art

A liquid electrophotographic printer develops a latent electrostatic image formed on a photosensitive medium using a developer liquid and prints a desired image.

In such a printer, a development region having substantially the same width as that of a development roller of the printer is formed on a photoreceptor belt. Developer liquid sticking to the development region is compressed by a squeegee roller, and only the developer liquid required for development of the latent electrostatic image remains thereon, with excess developer liquid being removed.

However, a problem arises in that the excess developer liquid tends to be pushed outside the development region of the photoreceptor belt by a wrap-around phenomenon in which the excess developer liquid moves to both edges of the squeegee roller along a gap between the squeegee roller and the photoreceptor belt. In that case, an air nozzle can be used to spray air toward the wrap-around developer liquid, thereby preventing the wrap-around developer liquid from flowing outside the development region of the photoreceptor belt.

However, a further problem arises in that, if the air is not properly sprayed or the air spraying force is weak due to clogging of the air nozzle or malfunction of a pump associated therewith, the wrap-around developer liquid flows toward both edges of the development region of the photoreceptor belt. Thus, the wrap-around developer liquid results in developer liquid contamination and degrading of print quality in the printed image. In particular, in the case of a color printer, discoloration of the printed image may occur due to mingling of differently colored inks.

SUMMARY OF THE INVENTION

To solve the above problems, it is an object of the present invention to provide a developer liquid squeegee apparatus for a liquid electrophotographic printer having enhanced print quality by additionally providing an arrangement for cleaning developer liquid wrap-around outside the development region of a photoreceptor belt.

In order to achieve the above object, there is provided a developer liquid squeegee apparatus for a liquid electrophotographic printer comprising a first squeegee roller for squeegeeing developer liquid supplied to a development region of a photoreceptor belt and removing excess developer liquid, a pair of air nozzles for spraying air toward both edges of the first squeegee roller to prevent the wrap-around developer liquid from being induced thereto, a heating roller for drying the developer liquid on an image developed on the development region of the photoreceptor belt; and a wrap-around developer liquid removing arrangement provided between the first squeegee roller and the heating roller.

According to the present invention, the wrap-around developer liquid removing arrangement includes a detector provided directly under both edges of the development region of the. photoreceptor belt for detecting the presence of the wrap-around developer liquid sticking to both edges of the development region of the photoreceptor belt, a second squeegee roller for removing the wrap-around developer liquid sticking to both edges of the development region of the photoreceptor belt while selectively contacting the photoreceptor belt and rotating according to a signal transmitted from an optical sensor module and indicative of the detection result, and a driving unit for driving the second squeegee roller to selectively contact the photoreceptor belt.

In addition, a ring-shaped cleaning member which is brought into contact with both edges of the development region of the photoreceptor belt to remove the developer liquid thereon may be provided at both ends of the second squeegee roller.

Preferably, the driving unit includes a frame having one end rotated by the driving of the actuator and which rotatably supports both ends of the second squeegee roller, and a controller for driving the actuator according to the signal transmitted from the detector, the second squeegee roller selectively contacting the photoreceptor belt or the heating roller according to the signal transmitted from the detector.

BRIEF DESCRIPTION OF THE DRAWINGS

A more complete appreciation ofthe invention, and may ofthe attendant advantages, thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENTS

Figure 1:
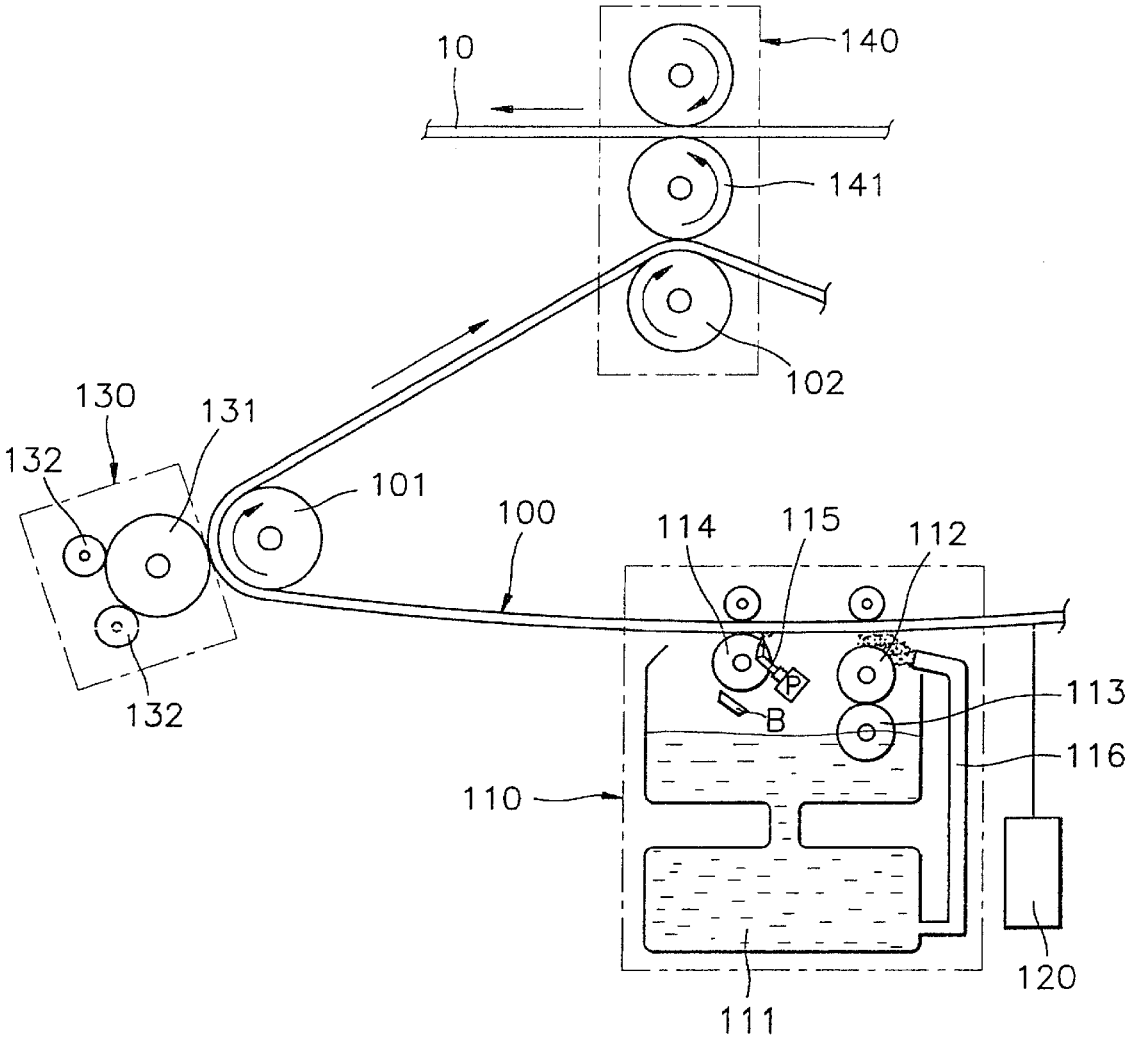
FIG. 1 is a schematic diagram illustrating essential parts of a liquid electrophotographic printer.

FIG. 1 is a schematic diagram illustrating essential parts of a liquid electrophotographic printer. As shown in FIG. 1, a liquid electrophotographic printer includes a photoreceptor belt 100 circulating on an endless track around a plurality of rotation rollers 101 and 102, laser scanning units (LSUs) 120 installed in the vicinity of the photoreceptor belt 100, a development unit 110, a drying unit 130 and a printing unit 140.

The LSUs 120 form latent electrostatic images on a transfer surface ofthe photoreceptor belt 100 by irradiating laser beams. The development unit 110 supplies developer liquid to the latent electrostatic image and develops the same. An image formed by the developer liquid on the latent electrostatic image of the photoreceptor belt 100 is dried by a drying roller 131 and heating rollers 132 of the dry unit 130 and then transferred to a recording sheet 10 as an image by a transfer roller 141 and a pressing roller 142 of the printing unit 140.

The development unit 110 includes a developer liquid supplier 116 for supplying developer liquid 111, a development roller 112, a cleaning roller 113, a squeegee roller 114, an air nozzle 115 and a blade B.

The developer liquid supplier 116 supplies developer liquid 111 between the development roller 112 and the photoreceptor belt 100, and the cleaning roller 113 removes developer liquid 111 remaining on the surface of the development roller 112. The squeegee roller 114 removes excess developer liquid from the latent electrostatic image formed on the photoreceptor belt 100. The blade B removes developer liquid from the surface of the squeegee roller 114.

Figure 2:
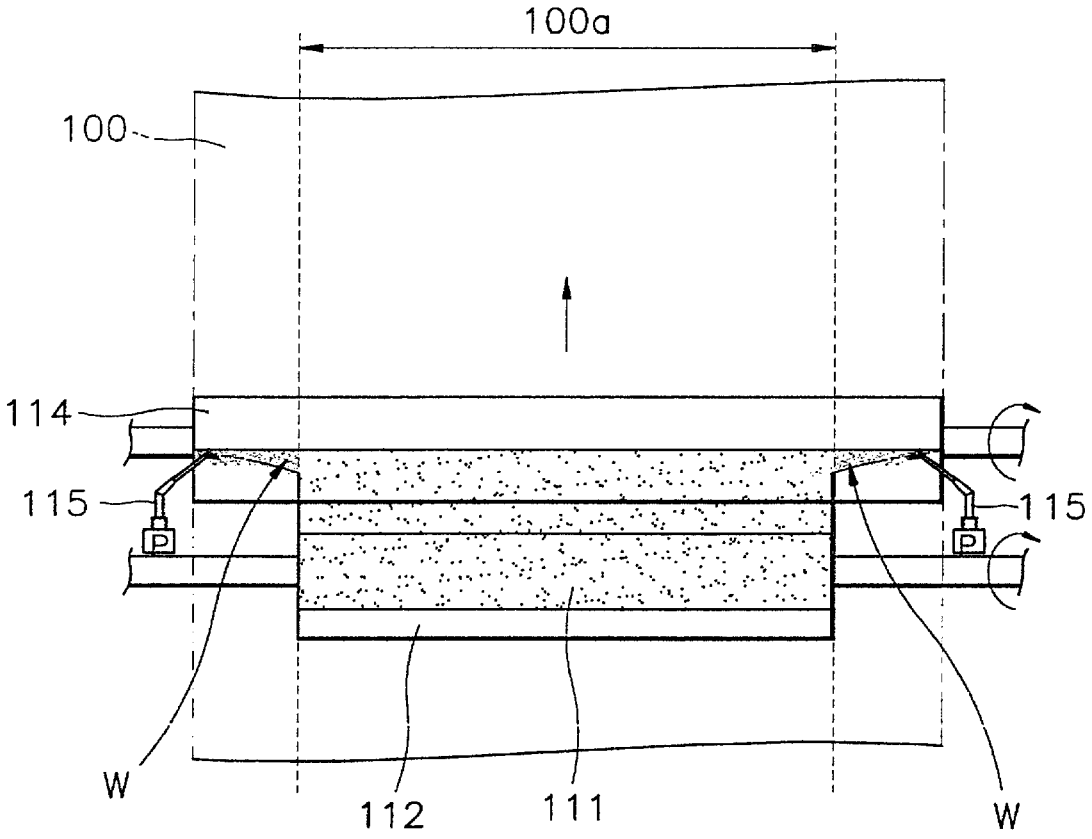
FIG. 2 is a plan view schematically illustrating essential parts of a developer liquid squeegee apparatus for the liquid electrophotographic printer shown in FIG. 1.
Figure 3:
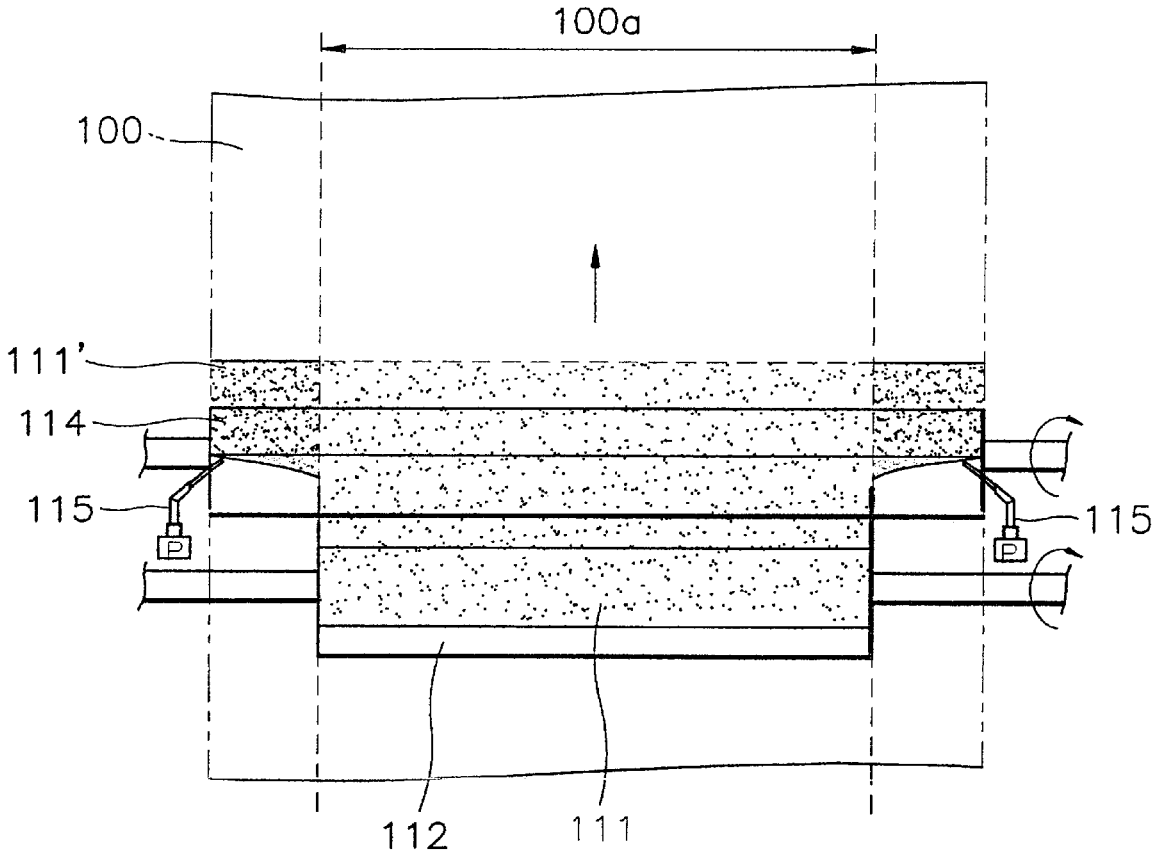
FIG. 3 illustrates a state in which developer liquid is wrapped around the squeegee apparatus in the liquid electrophotographic printer shown in FIG. 1.

FIG. 2 is a plan view schematically illustrating essential parts of a developer liquid squeegee apparatus for the liquid electrophotographic printer shown in FIG. 1, and FIG. 3 illustrates a state in which developer liquid is wrapped around the squeegee apparatus in the liquid electrophotographic printer shown in FIG. 1.

As shown in FIG. 2, a development region 100*a* having substantially the same width as that of the development roller 112 is formed on the photoreceptor belt 100. Developer liquid 111 sticking to the development region 100*a* is compressed by the squeegee roller 114, and only the developer liquid required for development of the latent electrostatic image remains thereon, with excess developer liquid being removed.

The excess developer liquid tends to be pushed outside the development region 100*a* of the photoreceptor belt 100 by a wrap-around phenomenon in which the excess developer liquid moves to both edges of the squeegee roller 114 along the gap between the squeegee roller 114 and the photoreceptor belt 100. The air nozzle 115 sprays air toward the wrap-around developer liquid W, thereby preventing the wrap-around developer liquid W from flowing outside the development region 100*a* of the photoreceptor belt 100.

However, in the case where the air is not properly sprayed or the air spraying force is weak due to clogging of the air nozzle 115 or malfunction of a pump P, as shown in FIG. 3, the wrap-around developer liquid 111' flows toward both edges of the development region 100*a* of the photoreceptor belt 100. Thus, the wrap-around developer liquid 111' results in developer liquid contamination, degrading print quality in the printed image. In particular, in the case of a color printer, discoloration of the printed image may occur due to mingling of differently colored inks.

Figure 4:
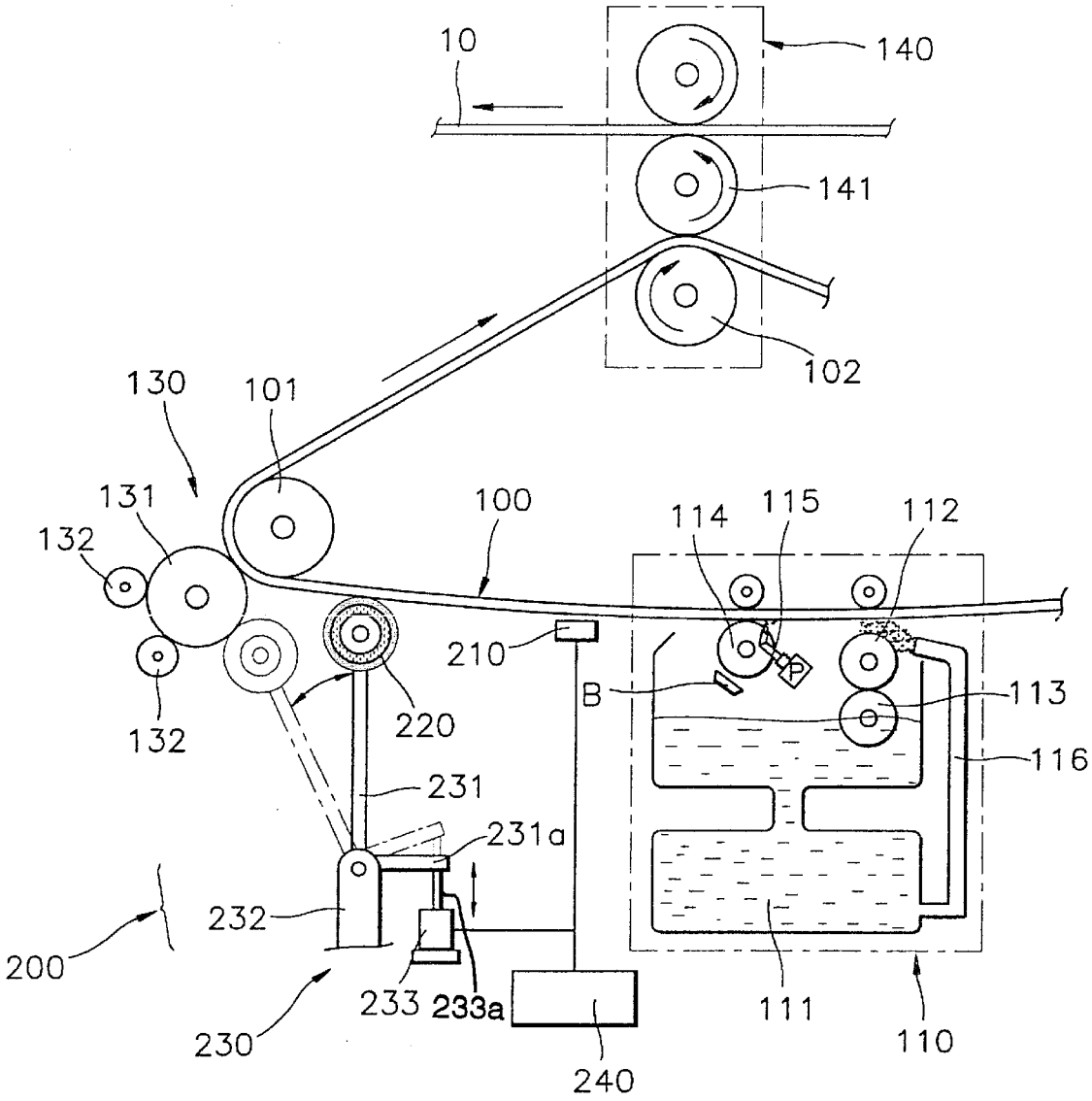
FIG. 4 is a schematic diagram illustrating essential parts of a developer liquid squeegee apparatus for a liquid electrophotographic printer according to the present invention.
Figure 5:
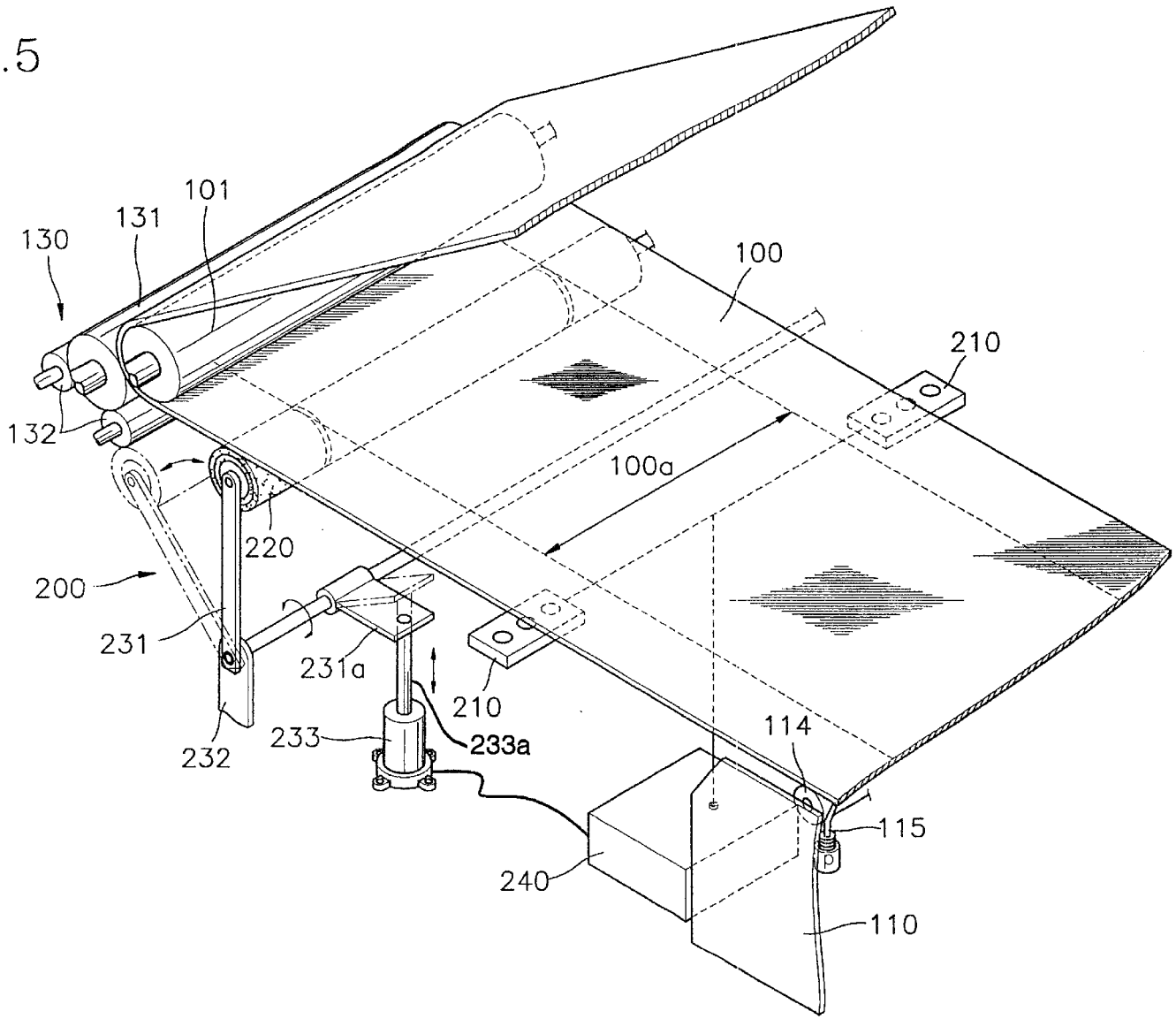
FIG. 5 is an extracted view schematically showing essential parts of the developer liquid squeegee apparatus shown in FIG. 4.

FIG. 4 is a schematic diagram illustrating essential parts of a developer liquid squeegee apparatus for a liquid electrophotographic printer according to the present invention, and FIG. 5 is an extracted view schematically showing essential parts of the developer liquid squeegee apparatus shown in FIG. 4.

Referring to FIGS. 4 and 5, a developer liquid squeegee apparatus for a liquid electrophotographic printer according to the present invention includes a first squeegee roller 114 for squeegeeing developer liquid supplied to a development region 100*a* of a photoreceptor belt 100 and removing excess developer liquid, an air nozzle 115 for spraying air toward both edges of the first squeegee roller 114, a heating roller 132 for drying developer liquid on an image developed on the development region 100*a* of the photoreceptor belt 100, and a wrap-around developer liquid removing arrangement 200 provided between the first squeegee roller 114 and the heating roller 132. In FIG. 4, the same reference numerals as those used in FIGS. 1 thru 3 are used to denote identical elements.

According to the present invention, in order to remove wrap-around developer liquid induced into both edges of the development region 100*a* of the photoreceptor belt 100 due to malfunction or abnormal operation of the air nozzle 115, the wrap-around developer liquid removing arrangement 200 includes an optical sensor module 210, a second squeegee roller 220 and a driving unit 230 for driving these elements.

The optical sensor module 210 includes a light emitting diode (not shown) and a light receiving diode (not shown), and is disposed directly under both edges of the development region 100*a* of the photoreceptor belt 100. The optical sensor module 210 detects the presence of the wrap-around developer liquid sticking to both edges of the development region 100*a* of the photoreceptor belt 100, and transmits a signal indicative of the detection result to the second squeegee roller 220 via a controller 240.

The second squeegee roller 220 selectively contacts the photoreceptor belt 100 or the heating roller 132 according to the signal transmitted from the optical sensor module 210 via a controller 240.

The driving unit 230 for driving the second squeegee roller 220 includes a holder 231 for rotatably supporting both ends of the second squeegee roller 220, a frame 232 for rotatably supporting the holder 231, an actuator 233 for selectively rotating the holder 231, and a controller 240 for driving the actuator 233 according to the signal transmitted from the optical sensor module 210.

According to the present invention a cylinder or a solenoid may be used as the actuator 233. In this case, the driving shaft 233*a* of the cylinder or solenoid is connected to a protrusion 231*a* provided in the holder 231, and the driving shaft 233*a* reciprocates linearly to interact with the protrusion 231*a*, thereby rotating the holder 231. The holder 231 is axially coupled to both ends of the second squeegee roller 220 to allow rotation of the second squeegee roller 220, and holder 231 is hinged to the frame 232 so as to be rotated.

According to another aspect of the present invention, a cam mechanism connected to the driving shaft of a driving motor to be rotated may be used as the actuator 233. According to this configuration, although not shown, the cam mechanism interferes with the protrusion 231*a* of the holder 231 by the driving of a driving motor (not shown) to thus rotate the holder 231, thereby selectively bringing the second squeegee roller 220 into contact with the photoreceptor belt 100 or the heating roller 132.

Therefore, in the present invention, the actuator 233 can be implemented by various means, known to those of skill in the art, which means can interact with the protrusion 231*a* of the holder 231 for rotation, and such means are not limited to specific embodiments described above.

Figure 6:
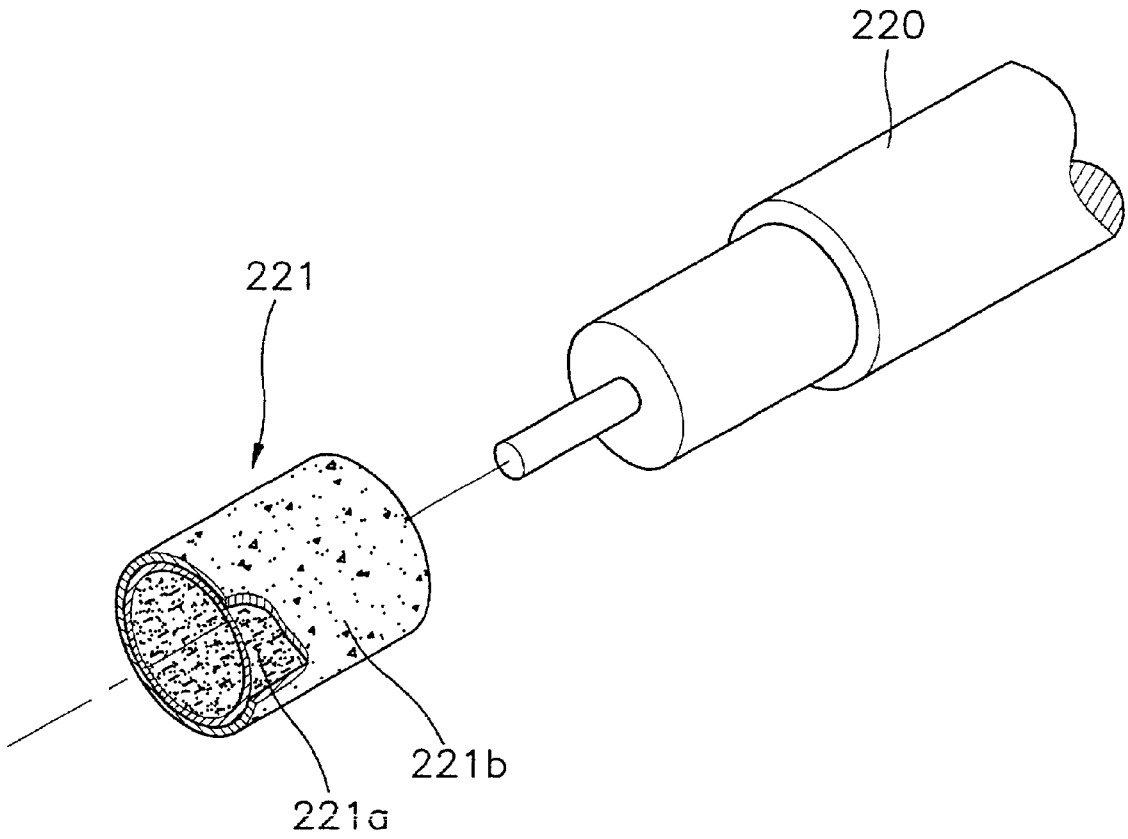
FIG. 6 is a partially exploded perspective view illustrating a second squeegee roller shown in FIGS. 4 and 5.

FIG. 6 is a partially exploded perspective view illustrating a second squeegee roller shown in FIGS. 4 and 5.

According to the present invention, as shown in FIG. 6, a ring-shaped cleaning member 221 which surrounds the outer circumferential surface of the second squeegee roller 220 is provided at both ends of the second squeegee roller 220. The cleaning member 221 has a double-layered structure comprised of an inner non-absorptive layer 221*a* making contact with the outer circumferential surface of the second squeegee roller 220, and an outer absorptive layer 221*b* stacked on the non-absorptive layer 221*a*. The non-absorptive layer 221*a* is preferably made of urethane rubber, and the absorptive layer 221*b* is preferably made of sponge or a foam material.

In the aforementioned developer liquid squeegee apparatus for a liquid electrophotographic printer, according to the present invention, in a situation where the developer liquid transferred to the photoreceptor belt 100 by the development roller 112 of the development unit 110 sticks to a development region 100*a* having the same width as that of the development roller 112, only that volume of developer liquid required for development remains on the development region 100*a*, and excess developer liquid is removed by the first squeegee roller 114. Some of the excess developer liquid causes the wrap-around phenomenon or problem in which the developer liquid deviates from the development region 100*a* along the gap between the squeegee roller 114 and the photoreceptor belt 100. In that case, the air nozzle 115 sprays air toward the wrap-around developer liquid, thereby preventing the developer liquid from flowing out of the development region 100*a* of the photoreceptor belt 100.

However, in the case where the air is not properly sprayed or the pressure of the sprayed air is weak due to clogging of the air nozzle 115 or malfunction of pump P, the wrap-around developer liquid flows toward both edges of the development region 100*a* of the photoreceptor belt 100 and sticks thereto. When the wrap-around developer liquid sticking to regions other than the development region 100*a* ofthe photoreceptor belt 100 migrates to the drying unit 130, the presence of the wrap-around developer liquid is detected by the optical sensor module 210. For example, the optical sensor module 210 can detect the presence ofthe wrap-around developer liquid by comparing light reflectivity for the case where the developer liquid does not stick to regions other than the development region 100*a* of the photoreceptor belt 100 with light reflectivity for the case where the developer liquid sticks to the development region 100*a*.

When the presence of the wrap-around developer liquid is detected by the optical sensor module 210, a signal indicative of the detection result is transmitted to the controller 240 of the driving unit 230 so as to control the actuator 233 to be driven. Then, the actuator 233 rotates the holder 231, supporting both ends of the second squeegee roller 220, so as to bring the second squeegee roller 220 into contact with the recording plane of the photoreceptor belt 100.

When the second squeegee roller 220 rotates into contact with the recording plane of the photoreceptor belt 100, it lightly presses the recording plane, and it removes the wrap-around developer liquid. Here, the absorptive layer 221*b* of the ring-shaped cleaning member 221, provided at both ends of the second squeegee roller 220, contacts both edges of the development region 100*a* of the photoreceptor belt 100 and absorbs the wrap-around developer liquid therefrom. The non-absorptive layer 221*a* prevents the developer liquid absorbed by the absorptive layer 221*b* from flowing downward to the surface of the second squeegee roller 220. The removal of wrap-around developer liquid by the cleaning member 221 of the second squeegee roller 220 is continuously performed while the photoreceptor belt 100 travels.

According to the present invention, a reference absorption amount of wrap-around developer liquid which can be absorbed by the cleaning member 221 of the second squeegee roller 220 is measured in advance. For example, the reference absorption amount is calculated by measuring the traveling distance of the photoreceptor belt 100 or the number of revolutions ofthe second squeegee roller 220, each of which corresponds to the reference absorption amount. Thus, while the cleaning member 221 of the second squeegee roller 220 performs the wrap-around developer liquid removal operation, a determination is made as to whether the traveling distance of the photoreceptor belt 100 or the number of revolutions of the second squeegee roller 220 reaches a reference absorption amount. Then, a signal indicative of the result of such determination is applied to the controller 240 so as to cause the actuator 233 to be driven. Accordingly, the actuator 233 rotates the holder 231, supporting both ends of the second squeegee roller 220, so as to bring the second squeegee roller 220 into contact with the heating roller 132. At this point, one cycle of the wrap-around developer liquid removal operation by the cleaning member 221 of the second squeegee roller 220 is completed, and the cleaning member 221, which is in contact with the heating roller 132, is heated so that the wrap-around developer liquid absorbed by the absorptive layer 231*b* of the cleaning member 221 is evaporated for subsequent recovery.

As described above, in the developer liquid squeegee apparatus for a liquid electrophotographic printer according to the present invention, in the case of malfunction of an air nozzle for spraying air toward the wrap-around developer liquid on both edges of a squeegee roller provided in a development unit to avoid a wrap-around problem, or in the case of weak air pressure, the presence of the wrap-around developer liquid is detected by an optical sensor module, and the wrap-around developer liquid is removed by a second squeegee roller. Therefore, it is possible to enhance the recovery efficiency of the developer liquid and to prevent degradation in print quality due to mingling or contamination due to non-removal of the wrap-around developer liquid by the first squeegee roller and air nozzles.

It should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. A developer liquid squeegee apparatus for a liquid electrophotographic printer, comprising:

a first squeegee roller for squeegeeing developer liquid supplied to a development region of a photoreceptor belt and removing excess developer liquid;

a pair of air nozzles for spraying air toward both edges of the first squeegee roller to prevent a wrap-around developer liquid from being induced thereto;

a heating roller for drying the developer liquid on an image developed on the development region of the photoreceptor belt; and wrap-around developer liquid removing means provided between the first squeegee roller and the heating roller for removing the wrap-around developer liquid from the development region, said wrap-around developer liquid removing means comprising a detector provided directly under edges of the development region of the photoreceptor belt for detecting a presence of the wrap-around developer liquid at the edges of the development region of the photoreceptor belt, and a second squeegee roller for removing the wrap-around developer liquid at the edges of the development region of the photoreceptor belt while selectively contacting the photoreceptor belt and rotating according to a signal, indicative of a detection result transmitted by the detector.

2. The developer liquid squeegee apparatus according to claim 1, wherein the wrap-around developer liquid removing means further comprises:

a driving unit for driving the second squeegee roller to selectively contact the photoreceptor belt.

3. The developer liquid squeegee apparatus according to claim 2, wherein the driving unit drives the second squeegee roller to selectively contact at least one of the photoreceptor belt and the heating roller according to the signal transmitted from the detector.

4. The developer liquid squeegee apparatus according to claim 2, wherein the driving unit comprises:

an actuator;

a frame having an end rotated by the actuator and rotatably supporting the ends ofthe second squeegee roller; and a controller for driving the actuator according to the signal transmitted from the detector.

5. The developer liquid squeegee apparatus according to claim 4, wherein the actuator is one of a cylinder, a solenoid and a cam driven by a driving motor.

6. The developer liquid squeegee apparatus according to claim 1, further comprising a ring-shaped cleaning member provided at the ends of the second squeegee roller and brought into contact with the edges of the development region of the photoreceptor belt to remove the developer liquid.

7. The developer liquid squeegee apparatus according to claim 6, wherein the ring-shaped cleaning member has a stacked structure including at least two layers comprising a non-absorptive layer which makes contact with outer circumferential surfaces of the ends of the second squeegee roller, and an absorptive layer surrounding the non-absorptive layer and brought into contact with the edges of the development region of the photoreceptor belt for absorbing the developer liquid.

8. The developer liquid squeegee apparatus according to claim 7, wherein the non-absorptive layer of the ring-shaped cleaning member is made of urethane rubber.

9. The developer liquid squeegee apparatus according to claim 8, wherein the absorptive layer is made of at least one of sponge and a foaming material.

10. The developer liquid squeegee apparatus according to claim 1, wherein the detector comprises an optical sensor module having a light emitting diode and a light receiving diode.

11. A developer liquid squeegee apparatus for a liquid electrophotographic printer, comprising:

a first squeegee roller for squeegeeing developer liquid supplied to a development region of a photoreceptor belt and removing excess developer liquid;

a heating roller for drying the developer liquid on an image developed on the development region of the photoreceptor belt; and wrap-around developer liquid removing means provided between the first squeegee roller and the heating roller for removing wrap-around developer liquid from the development region, said wrap-around developer liquid removing means comprising a detector provided directly under edges of the development region of the photoreceptor belt for detecting a presence of the wrap-around developer liquid at the edges of the development region of the photoreceptor belt, and a second squeegee roller for removing the wrap-around developer liquid at the edges of the development region of the photoreceptor belt while selectively contacting the photoreceptor belt and rotating according to a signal, indicative of a detection result, transmitted by the detector.

12. The developer liquid squeegee apparatus according to claim 11, wherein the wrap-around developer liquid removing means further comprises:

a driving unit for driving the second squeegee roller to selectively contact the photoreceptor belt.

13. The developer liquid squeegee apparatus according to claim 12, wherein the driving unit drives the second squeegee roller to selectively contact at least one of the photoreceptor belt and the heating roller according to the signal transmitted from the detector.

14. The developer liquid squeegee apparatus according to claim 12, wherein the driving unit comprises:

an actuator;

a frame having an end rotated by the actuator and rotatably supporting the ends of the second squeegee roller; and a controller for driving the actuator according to the signal transmitted from the detector.

15. The developer liquid squeegee apparatus according to claim 14, wherein the actuator is one of a cylinder, a solenoid and a cam driven by a driving motor.

16. The developer liquid squeegee apparatus according to claim 11, further comprising a ring-shaped cleaning member provided at the ends of the second squeegee roller and brought into contact with the edges of the development region of the photoreceptor belt to remove the developer liquid.

17. The developer liquid squeegee apparatus according to claim 16, wherein the ring-shaped cleaning member has a stacked structure including at least two layers comprising a non-absorptive layer which makes contact with outer circumferential surfaces of the ends of the second squeegee roller, and an absorptive layer surrounding the non-absorptive layer and brought into contact with the edges of the development region of the photoreceptor belt for absorbing the developer liquid.

18. The developer liquid squeegee apparatus according to claim 17, wherein the non-absorptive layer of the ring-shaped cleaning member is made of urethane rubber.

19. The developer liquid squeegee apparatus according to claim 18, wherein the absorptive layer is made of at least one of sponge and a foaming material.

20. The developer liquid squeegee apparatus according to claim 11, wherein the detector comprises an optical sensor module having a light emitting diode and a light receiving diode.

21. A developer liquid squeegee apparatus for a liquid electrophotographic printer comprising:

a first squeegee roller for squeegeeing developer liquid supplied to a development region of a photoreceptor belt and removing excess developer liquid;

a pair of air nozzles for spraying air toward both edges of the first squeegee roller to prevent a wrap-around developer liquid from being induced thereto; and wrap-around developer liquid removing means provided downstream of the first squeegee roller for removing the wrap-around developer liquid from a development region of the photoreceptor belt, said wrap-around developer liquid removing means comprising a detector provided directly under edges of the development region of the photoreceptor belt for detecting a presence of the wrap-around developer liquid at the edges of the development region of the photoreceptor belt, and a second squeegee roller for removing the wrap-around developer liquid at the edges of the development region of the photoreceptor belt while selectively contacting the photoreceptor belt and rotating according to a signal indicative of a detection result transmitted by the detector.

22. The developer liquid squeegee apparatus according to claim 21, wherein the wrap-around developer liquid removing means further comprises:

a driving unit for driving the second squeegee roller to selectively contact the photoreceptor belt.

23. The developer liquid squeegee apparatus according to claim 22, wherein the driving unit drives the second squeegee roller to selectively contact the photoreceptor belt according to the signal transmitted from the detector.

24. The developer liquid squeegee apparatus according to claim 22, wherein the driving unit comprises:

an actuator;

a frame having an end rotated by the actuator and rotatably supporting the ends of the second squeegee roller; and a controller for driving the actuator according to the signal transmitted from the detector.

25. The developer liquid squeegee apparatus according to claim 24, wherein the actuator is one of a cylinder, a solenoid and a cam driven by a driving motor.

26. The developer liquid squeegee apparatus according to claim 21, further comprising a ring-shaped cleaning member provided at the ends of the second squeegee roller and brought into contact with the edges of the development region of the photoreceptor belt to remove the developer liquid.

27. The developer liquid squeegee apparatus according to claim 26, wherein the ring-shaped cleaning member has a stacked structure including at least two layers comprising a non-absorptive layer which makes contact with outer circumferential surfaces of the ends of the second squeegee roller, and an absorptive layer surrounding the non-absorptive layer and brought into contact with the edges of the development region of the photoreceptor belt for absorbing the developer liquid.

28. The developer liquid squeegee apparatus according to claim 27, wherein the non-absorptive layer of the ring-shaped cleaning member is made of urethane rubber.

29. The developer liquid squeegee apparatus according to claim 28, wherein the absorptive layer is made of at least one of sponge and a foaming material.

30. The developer liquid squeegee apparatus according to claim 21, wherein the detector comprises an optical sensor module having a light emitting diode and a light receiving diode.

* * * * *